US012312957B2

(12) United States Patent
Reumuller et al.

(10) Patent No.: US 12,312,957 B2
(45) Date of Patent: May 27, 2025

(54) CABLE HANDLING DEVICE FOR CABLE BOLTS

(71) Applicant: SANDVIK MINING AND CONSTRUCTION G.M.B.H., Zeltweg (AT)

(72) Inventors: Bruno Reumuller, Knittelfeld (AT); Thomas Galler, Althofen (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 270 days.

(21) Appl. No.: 18/011,303

(22) PCT Filed: May 29, 2020

(86) PCT No.: PCT/EP2020/064953

§ 371 (c)(1),
(2) Date: Dec. 19, 2022

(87) PCT Pub. No.: WO2021/239245

PCT Pub. Date: Dec. 2, 2021

(65) Prior Publication Data

US 2023/0235668 A1 Jul. 27, 2023

(51) Int. Cl.
*E21D 20/00* (2006.01)
*E21D 21/00* (2006.01)

(52) U.S. Cl.
CPC ..... *E21D 20/006* (2013.01); *E21D 21/006* (2016.01)

(58) Field of Classification Search
CPC ... E21D 20/003; E21D 20/006; E21D 21/006; E21D 21/0093
See application file for complete search history.

(56) References Cited

U.S. PATENT DOCUMENTS 4,079,592 A * 3/1978 Eakin ..... E21D 20/003 405/259.5
4,504,175 A * 3/1985 Zion ..... E21D 20/025 405/259.1
4,589,803 A 5/1986 Totten, III
4,710,065 A * 12/1987 Leppanen ..... E21D 20/003 405/303
4,728,219 A * 3/1988 Leppanen ..... E21D 20/003 242/129
5,419,660 A * 5/1995 Marquis ..... E21D 21/006 405/303
6,030,151 A * 2/2000 Woolnough ..... E21D 20/003 405/302.2

(Continued)

FOREIGN PATENT DOCUMENTS

AU 2665884 A 11/1984
AU 2010200388 A1 8/2016

(Continued)

*Primary Examiner* — Benjamin F Fiorello
(74) *Attorney, Agent, or Firm* — Corinne R. Gorski

(57) ABSTRACT

A cable handling device for an underground mining drill rig, wherein the cable handling device includes a first feeding assembly having a cable bending guide and a first feeding device configured to receive a cable, grip the cable and feed the cable in a first direction into the cable bending guide. The cable bending guide is configured to guide the cable along an arcuate path such that the cable exits the cable bending guide in a second direction offset a predetermined angle to the first direction.

13 Claims, 3 Drawing Sheets

(56) References Cited

U.S. PATENT DOCUMENTS

| | | | | |
|---|---|---|---|---|
| 6,863,476 | B2 * | 3/2005 | Malkoski | E21D 20/00 405/303 |
| 7,547,161 | B2 * | 6/2009 | Gascon | E21D 20/006 405/259.1 |
| 8,727,669 | B2 * | 5/2014 | Eddowes | B65H 51/10 226/188 |
| 9,815,660 | B2 | 11/2017 | Eddowes et al. | |
| 2007/0286707 | A1 * | 12/2007 | Eddowes | E21B 19/20 414/22.51 |
| 2014/0238715 | A1 * | 8/2014 | Eddowes | B65H 51/10 173/215 |

FOREIGN PATENT DOCUMENTS

| | | | |
|---|---|---|---|
| CN | 101784751 | A | 7/2010 |
| CN | 103161483 | A | 6/2013 |
| CN | 106894773 | A | 6/2017 |
| CN | 207420600 | U | 5/2018 |
| CN | 108825276 | A | 11/2018 |
| CN | 110566251 | A | 12/2019 |
| GB | 2182694 | A | 5/1987 |
| JP | H0972186 | A | 3/1997 |
| RU | 1816862 | A1 | 5/1993 |
| RU | 2488000 | C2 | 7/2013 |
| RU | 2527839 | C2 | 9/2014 |
| RU | 2643053 | C2 | 1/2018 |
| WO | 1998048147 | | 10/1998 |

* cited by examiner

CABLE HANDLING DEVICE FOR CABLE BOLTS

RELATED APPLICATION DATA

This application is a § 371 National Stage Application of PCT International Application No. PCT/EP2020/064953 filed May 29, 2020.

TECHNICAL FIELD

The present disclosure relates to ground reinforcement systems and specifically to improvements related to drill rig systems for drilling bore holes and inserting cable into the drilled bore hole.

BACKGROUND

In tunneling operations, such as mining, it is common to reinforce or support the roof and walls of the tunnel to prevent the roof and walls collapsing which can in certain circumstances cause significant loss of life and machinery. Many types of reinforcement methods and apparatus have been developed in an attempt to reinforce roof and walls. One such method is by use of anchor bolts of various shapes and sizes which are inserted into respective bore holes and anchored by mechanical expansion or using grout/resin. Cables, meshing and the like, are strung between the ends of those anchor bolts to support the roof or wall.

Another method is to insert a steel cable or the like into the bore hole either as an enhancement to a fixed rigid elongated anchor bolt or as a primary support measure. In this method, miners insert a first set of grouting or bonding material or the like and then force the cable into the bore hole and when in position and pre-tensioned, insert a second set of grouting, bonding material or the like into the bore hole and around the cable to ensure the cable is securely fixed and anchored to the surrounding rock. Stiffening material, a drive head or the like can also be added to the front or first end of the cable to assist with driving the cable into the bore hole. When installing a cable into a bore hole heavy manual handling is required by the miner to push the cable into the bore hole. The relative stiffness of the cable and the heavy weight of the cable means that manual handling is very difficult, time consuming and can easily lead to injuries to the miners. Also, the manual exertion involved in pushing a cable into a bore hole in some circumstances results in the cable not fully penetrating the bore hole which can lead to a less than satisfactory anchor in the mine roof or wall.

AU2010200388A1 relates to technology for mitigating such cable handling problems by providing a cable feeder with a roller-based drive system. The rollers are movable to accommodate for cables of varying diameter.

A drawback of this device is however that a lot of manual handling of the cable is still needed to get it into the drilled bore hole.

Another feeding device is shown in PCT/FI98/00338. The feeding device is for feeding bulb anchor wire rather than cable, and has movable rollers for feeding the wire. The movable rollers are biased by a loading means against the wire to enable use with different types of wire having different diameter.

U.S. Pat. No. 9,815,660B2 discloses a cable feeding device designed to be mounted of top of a drill rig to feed a cable bolt into a bore hole. The cable feeding device comprises a transmission to be coupled to the drill head of the drill rig, wherein the transmission transmits power from the drill head to one or more drive wheels of the cable feeding device upon rotation of the drill head. A drawback of this cable feeding device is that it adds height on top of the drill rig. Sometimes the mine tunnels in which the drill rig operates are small such that the cable feeding device will not fit in the tunnel.

Accordingly, an object of the invention is to provide an improved means for promoting safe and swift installation of cable bolts regardless of tunnel size.

SUMMARY

According to a first aspect of the disclosure, the above-mentioned object is achieved by a cable handling device for an underground mining drill rig as described herein. The cable handling device comprises a first feeding assembly comprising a cable bending guide and a first feeding device. The first feeding device is configured to receive a cable, grip the cable and feed the cable in a first direction into the cable bending guide. The cable bending guide is configured to guide the cable along an arcuate path such that the cable exits the cable bending guide in a second direction offset a predetermined angle to the first direction, such as 90 degrees+−10 degrees.

The cable bending guide may comprise an arcuate tube for guiding the cable through the arcuate tube from the first feeding device along said arcuate path. Alternatively, the cable bending guide (4) may comprise a plurality of guide wheels arranged along the arcuate path for guiding the cable along the arcuate path.

In use, the first feeding device receives a free end of a nearby cable reel or other cable storage device. The first feeding device then feeds the cable through the cable bending guide which gradually bends the cable such that it leaves the cable bending guide in the second direction offset the predetermined angle from the first direction. Thereby, the free end of the cable can easily be moved from the cable reel (or other cable storage device) and then be automatically redirected into the second direction which is chosen based on the task at hand. Typically, the second direction is parallel to the drilling direction of the drill rig such that the cable can then be moved into the drilled bore without any substantial further bending. The arcuate tube provides a robust and simple means of bending/redirecting the cable as the cable is fed further into the arcuate tube by the first feeding device.

The first feeding device may be configured to receive the cable horizontally or in a direction within +−30 degrees to a horizontal plane, or within +−45 degrees to a horizontal plane. By configuring the first feeding device such that it is able to receive the cable substantially horizontally, the free end of the cable can easily be manually moved from a nearby cable reel (or other cable storage device) and straight into the first feeding device without any need of manually bending the cable.

The cable handling device may further comprise a second feeding assembly which comprises a second feeding device movably suspended on a suspension mechanism configured such that the second feeding device is movable back and forth between a first position for receiving the cable exiting the cable bending guide in the second direction, and a second position transversal to the first position with respect to the second direction. The second feeding assembly receives the free end of the cable from the cable bending guide and then moves the free end of the cable such that the cable aligns with the drilling axis of the drill rig. Once the cable is in the second position it can be further handled by the drill rig or by the second feeding assembly and fed into the drilled bore. Altogether, this system enables a cable to be automatically handled from the first feeding device and into a bore hole such that the need of human operators is reduced, thereby improving overall safety of the cable bolting operation.

The suspension mechanism may comprises a plurality of arms hingedly connected to each other such that the second feeding device is movable in a first plane, wherein each hinged connection is provided with a respective drive means for rotating the arms relatively each other thereby controlling the position of the second feeding device in the first plane.

The plurality of hingedly connected arms are rotated relatively each other by the motors thereby controlling the position of the second feeding assembly in the first plane such that the cable can be moved by the suspension mechanism into alignment with the drill rig without manual effort.

The suspension mechanism may be configured such that the first plane is normal to the second direction.

By aligning the movement of the suspension mechanism to the first feeding assembly such that the first plane is normal to the second direction, the cable can be moved perpendicularly to the second direction, i.e. sideways, a short distance until the cable is aligned with the drilling axis of the drill rig. Such sideway/transversal movement of the cable into the second position means the cable handling device can be positioned beside the drill rig which means the height of the drill rig is not affected by the cable handling device.

The second feeding assembly may comprise a gripping claw configured to be movable back and forth between a closed position for gripping the cable and an open position in which the cable is laterally movable out of the gripping claw. The gripping claw is provided with motorized feeding wheels for optionally holding or feeding the cable through the gripping claw in the closed position.

The motorized gripping claw allows the second feeding assembly to engage the cable and to disengage the cable without having to feed the end of the cable through the feeding assembly. This in turn enables the second feeding assembly to be moved out of the way of any mechanisms of the drill rig such that the drill rig can work as normal to feed the cable into the drilled bore hole. Hence, the present cable handling device is suitable for being retrofitted to existing drill rigs without reducing the drill stroke of the drill rig for the drilling process. The motorized drive wheels enable the second feeding assembly to control the position of the cable in the bore hole and feed the cable into the bore hole without relying on any other feeding device. This allows the trailing portion of the cable to be fed to a position where it can be connected to the drill head for finally being fed by the drill rig into the bore hole and for being rotated by the drill rig.

The radius of curvature of the cable bending guide may be chosen large enough for the cable not to be plastically deformed upon being fed through the arcuate tube. By so configuring the arcuate tube, plastic deformation of the cable is mitigated, which in turn makes the cable exiting the cable bending guide continue straight ahead along the second direction as more and more cable is fed through.

A second aspect of the disclosure relates to a drill rig system comprising both an underground mining drill rig and the above-mentioned cable handling device.

The drill rig system comprising the cable feeding device allows an operator to easily wind cable off a nearby cable reel (or other cable storage device) and move the cable into the first feeding assembly. The cable handling device then automatically moves the cable into the second position within the drill rig where the drill rig handles further movement of the cable for feeding into the drilled bore hole.

The cable handling device (1) may be configured such that the second direction (D2) differs from the drilling direction (D3) of the drill rig (2) by no more than +−10 degrees, or such that the second direction is parallel to the drilling direction of the drill rig.

By making the second direction parallel to the drilling direction of the drill rig, only sideways translation of the free end of the cable is necessary and no rotation. This simplifies the design of the suspension mechanism since it does not need to rotate or bend the cable to align it with the drilling direction.

The suspension mechanism may be configured such that the second feeding device in the second position is aligned with the drilling axis of the drill rig. In other words, the second position may be such that the cable held by the second feeding device in the second position is movable straight into the bore hole by the second feeding device.

A third aspect of the disclosure relates to a mining machine comprising a drill rig system as described above, wherein the mining machine could be a cutting machine provided with a bolter, a mobile bolter, a bolter car, a bolter miner or a roadheader.

A fourth aspect of the disclosure relates to a method of installing a cable bolt using a drill rig system as described above. The method comprising the steps of:

- moving a free end of a cable into the first cable feeding device,
- operating the first feeding device to feed the cable through the cable bending guide and into the second feeding device,
- operating the suspension mechanism to move the second feeding device to its second position,
- operating the second feeding device to feed the cable into a bore hole until the trailing portion of the cable is attachable to the drill head of the drill rig,
- disengaging the second feeding device from the cable,
- operating the suspension mechanism to move the second feeding device out of the way of the drill head,
- attaching the trailing portion of the cable to the drill head, and
- operating the drill head of the drill rig to work the cable further into the bore and to rotate the cable.

DETAILED DESCRIPTION

A cable handling device 1 according to a first embodiment will hereinafter be described with reference to the appended drawings. The cable handling device 1 is for use with a drill rig 2 such as the one shown in FIGS. 1-2. The cable handling device 1 may be sold separately or it may be sold as a drill rig 2 system together with a drill rig 2. The drill rig 2 system may be integrated with a mining machine M or provided as a system sold separately for use with any suitable carrying device. Below, the description firstly focuses on describing the handling device itself although the figures show the cable handling device 1 together with the drill rig 2.

Figure 1:
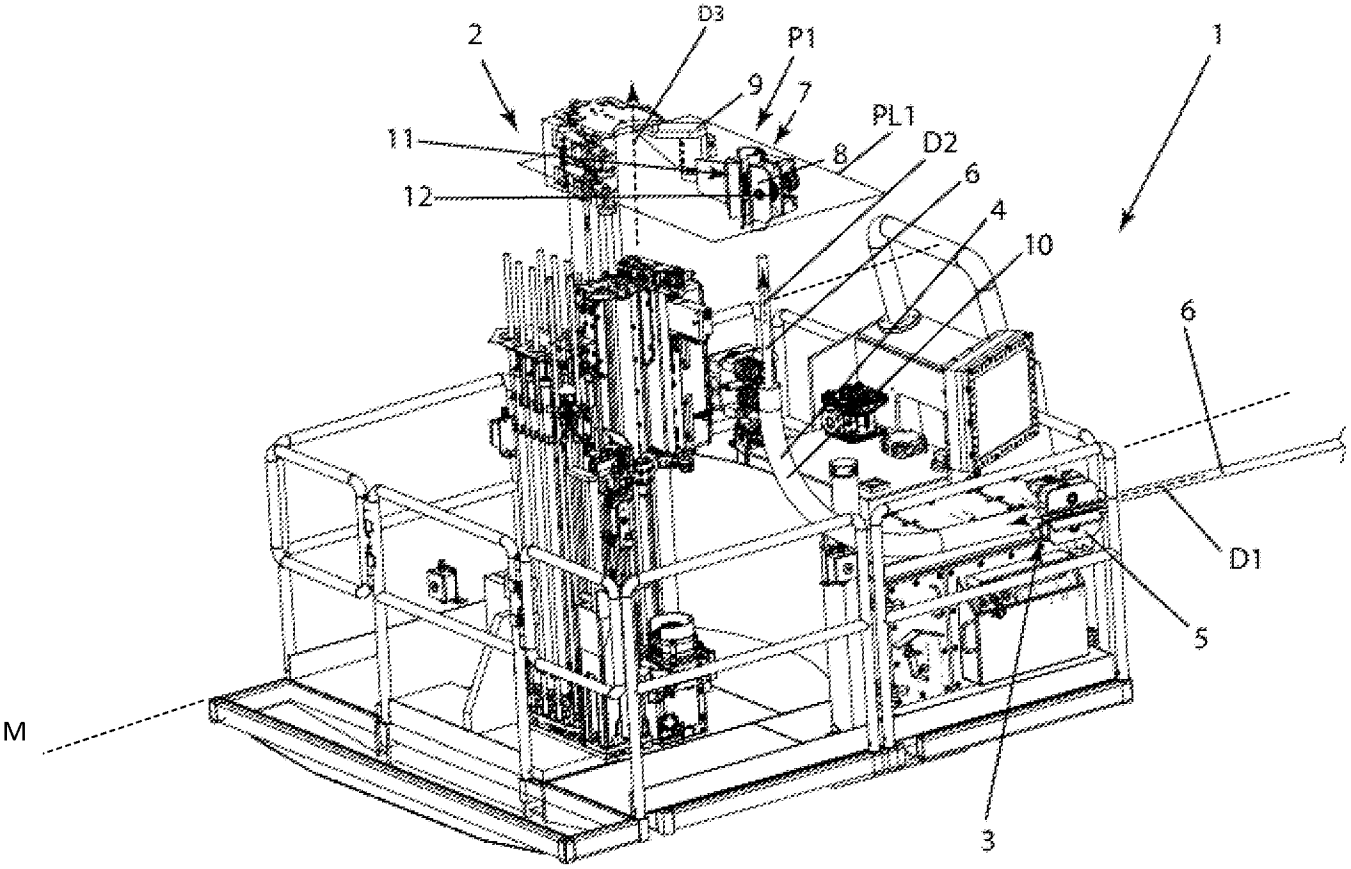
FIG. 1 shows a platform comprising a drill rig and a cable handling device according to a first embodiment with a cable being fed through the first feeding assembly from a ground position.
Figure 2:
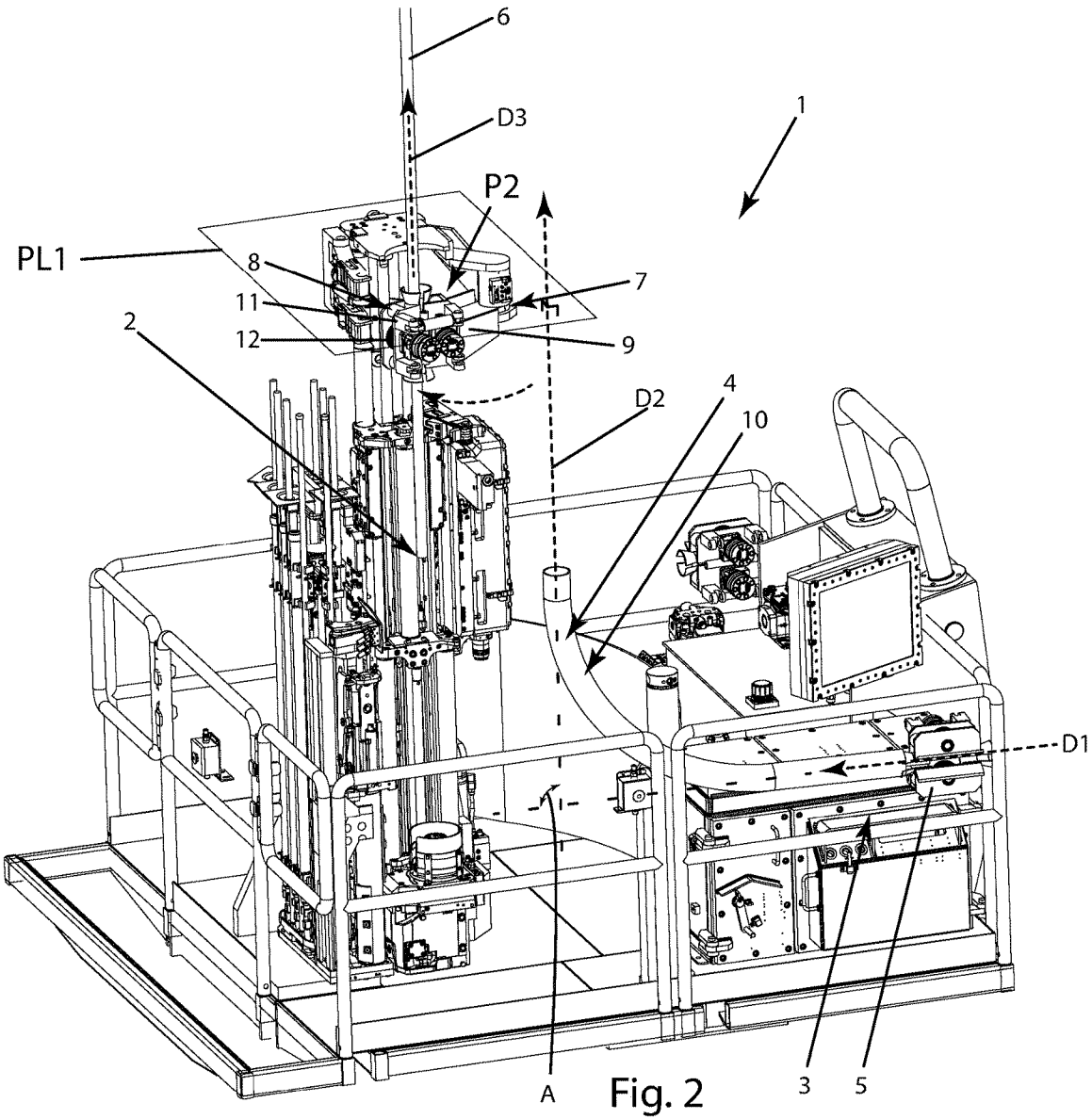
FIG. 2 shows the platform of FIG. 1 however with the cable fed further through the second feeding device and into the bore hole.
Figure 3:
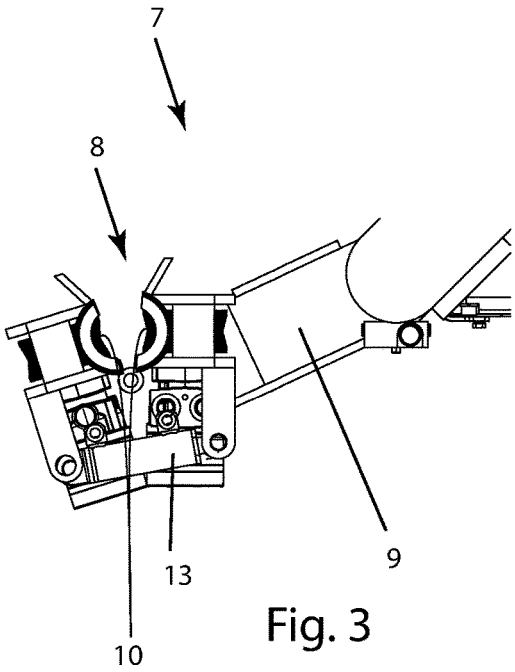
FIGS. 3-6 show various views of the second feeding assembly.
Figure 4:
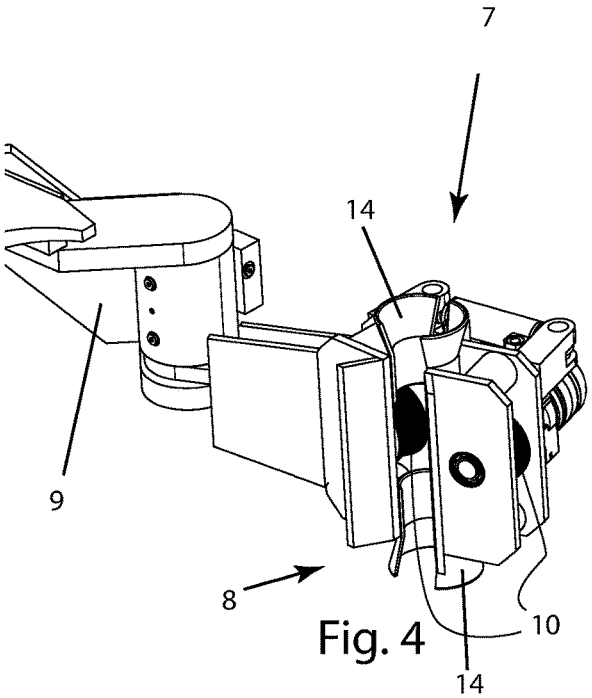
Figure 5:
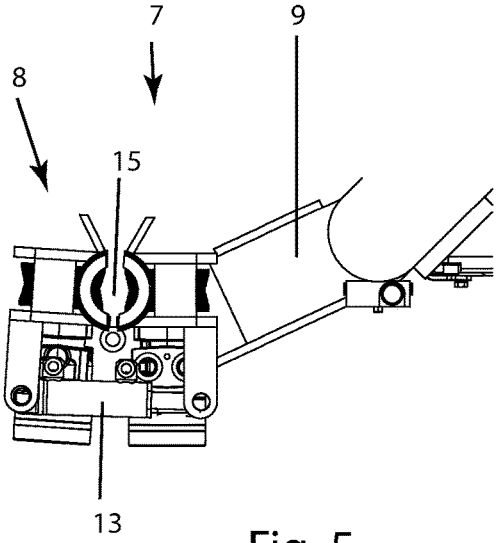
Figure 6:
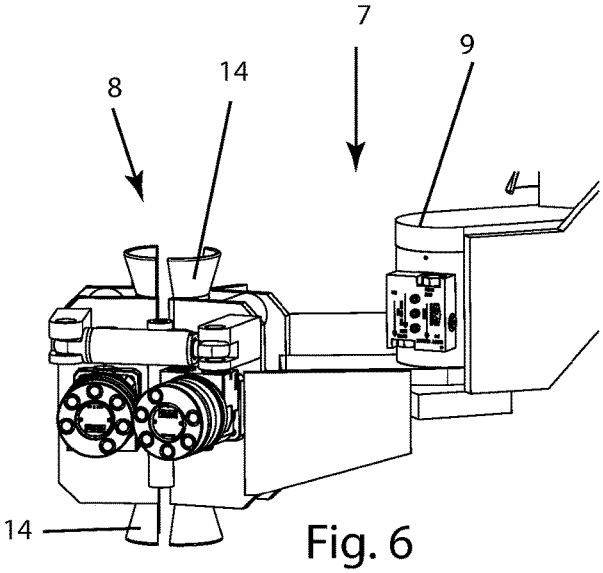

As shown in FIGS. 1-2, the cable handling device 1 comprises a first feeding assembly 3 comprising a cable bending guide 4 and a first feeding device 5. The first feeding device 5 is configured to receive a cable 6, grip the cable 6 and feed the cable 6 in a first direction D1 into the cable bending guide. The first feeding device 5 is provided with opposite wheels configured to receive the cable 6 between the wheels to frictionally engage the cable 6, wherein at least one of the wheels is operatively connected to a drive means such as an electric motor. In other embodiments, some other suitable drive means may be provided instead of the motorized wheels, such as a pair of movable gripping jaws configured to alternatingly grip and move the cable 6. Here, the first feeding device is configured to receive the cable horizontally, but it may in other embodiments be chosen to any other suitable direction, such as +−30 or +−45 degrees to a horizontal plane.

The cable bending guide 4 is configured to guide the cable 6 along an arcuate path such that the cable 6 exits the cable bending guide 4 in a second direction D2 offset a predetermined angle to the first direction D1. The cable bending guide 4 comprises an arcuate tube 10 for guiding the cable 6 through the arcuate tube 10 from the first feeding device 5 along said arcuate path. In other embodiments, some other suitable means for guiding the cable 6 whilst bending it to follow the arcuate path could be provided instead of the arcuate tube 10, such as consecutive opposing pairs of wheels arranged along the arcuate path and configured to guide the cable 6 between the pairs of wheels.

The cable handling device 1 further comprises a second feeding assembly 7 which comprises a second feeding device 8 movably suspended on a suspension mechanism 9.

The suspension mechanism 9 is configured such that the second feeding device 8 is movable back and forth between a first position P1, shown in FIG. 1, for receiving the cable exiting the cable bending guide 4 in the second direction D2, and a second position P2, shown in FIG. 2, from which the cable 6 can be fed into the bore hole. The second position P2 is generally transverse to the first position P1 with respect to the second direction D2. By moving the second feeding device 8 transversely to the second direction D2, the second feeding device 8, and thus the cable 6, can be moved sideways into the drill rig 2, between the retracted drill head and the outer portion of the drill rig 2. From there, the cable 6 can be fed into the bore hole by the second feeding device 8. The sideways movement of the second feeding device 8 hence allows for the use of the second feeding device 8 without adding to the height of the drill rig 2 by allowing the second feeding device 8 to operate from an intermediate position along the length of the drill rig 2, and the be moved back to the first position P1 sideways and thus out of the way of the drill head of the drill rig 2, thereby still allowing the drill head to work its full stroke.

In this embodiment, the second position P2 is a position in which the second feeding device 8 holds the cable 6 aligned with the drilling axis of the drill rig 2. However, the second position P2 could in other embodiments alternatively differ slightly as long as the cable 6 can be fed into the opening of the bore hole and further into the bore hole by the second feeding assembly 7 when in the second position P2.

The suspension mechanism 9 comprises a plurality of arms hingedly connected to each other such that the second feeding device 8 is movable in a first plane. Each hinged connection is provided with a respective drive means for rotating the arms relatively each other thereby controlling the position of the second feeding device 8 in the first plane.

The second feeding assembly 7 comprises a gripping claw 11 configured to be movable back and forth between a closed position for gripping the cable 6 and an open position in which the cable 6 is laterally movable out of the gripping claw 11. The gripping claw 11 is provided with motorized feeding wheels 12 for optionally holding or feeding the cable 6 through the gripping claw 11 in the closed position. In other embodiments, the second feeding assembly 7 may instead of a gripping claw 11 have any other suitable feeding mechanism.

As shown in FIGS. 1-2, the cable feeding device is used together with a drill rig 2, and those may be provided together as a drill rig system. The cable handling device 1 of the drill rig system is typically configured such that the second direction D2 is parallel to the drilling direction D3 of the drill rig 2, as shown in FIG. 2. Typically, the drilling direction is close to vertical, such as vertical +−10 degrees. The second direction may in other embodiments differ some degrees to the drilling direction, for example no more than +−10 degree to the drilling direction. The suspension mechanism 9 is configured to move the cable 6 by sideways translation from the first position P1 into alignment with the drilling axis of the drill rig 2 in the second position P2. However, should the second direction D2 in some other embodiment not be parallel to the drilling axis of the drill rig 2, the suspension mechanism 9 may alternatively be configured to both translate and rotate the cable 6 upon movement to the second position P2, in order to thereby bring the cable 6 into alignment with the drilling direction D3.

Various views of the second feeding assembly 7 is shown in FIGS. 3-6. The suspension mechanism 9 comprises an articulated arm with sections which are connected by rotatable hinges/joints. Relative rotation between the sections of the articulated arm is enabled by the provision of suitable drive means such as stepper motors. The second feeding device 8 is provided with two jaws forming the gripping claw 11. Each jaw is provided with a feeding wheel 12 such that the cable can be gripped between the feeding wheels 12 by closing the jaws/gripping claw 11. An actuator 13 is provided for controlling the opening/closing of the gripping claw 11 as best shown comparing FIGS. 3 and 5. The gripping claw 11 is configured to laterally receive the cable in a central through passage 15 when the gripping claw 11 is open, and to retain the cable in the central through passage 15 when the gripping claw 11 is closed. The second feeding device is provided with guide screens 14 on each end of the central through passage 15 for guiding the cable towards the central through passage 15. The guide screen 14 facing the cable bending guide 4 hence guides the leading end portion of the cable 6 into the central through passage 15 as the cable is first fed by the first feeding device into the second feeding device.

The drill rig system may be operated using the following method. The method comprises the steps of:

- moving a free end of a cable 6 into the first cable feeding device,
- operating the first feeding device 5 to feed the cable 6 through the cable bending guide 4 and into the second feeding device 8,
- operating the suspension mechanism 9 to move the second feeding device 8 to its second position P2, operating the second feeding device 8 to feed the cable 6 into a bore hole until the trailing portion of the cable 6 is attachable to the drill head of the drill rig 2, disengaging the second feeding device 8 from the cable 6, operating the suspension mechanism 9 to move the second feeding device 8 out of the way of the drill head, attaching the trailing portion of the cable 6 to the drill head, and operating the drill head of the drill rig 2 to work the cable 6 further into the bore and to rotate the cable 6.

Both the second feeding device 8 and the first feeding device 5 may alternatively be operated simultaneously to ease movement of the cable 6 into the bore hole. When moving the second feeding device 8 out of the way of the drill head, the second feeding device 8 is typically moved to the first position P1, although other positions may alternatively be used.

The invention claimed is:

1. A drill rig system comprising:

a drill rig; and a cable handling device, the cable handling device comprising a first feeding assembly including a cable bending guide and a first feeding device configured to receive a cable, grip the cable and feed the cable in a first direction into the cable bending guide, wherein the cable bending guide is configured to guide the cable along an arcuate path such that the cable exits the cable bending guide in a second direction offset a predetermined angle to the first direction, and a second feeding assembly which includes a second feeding device movably suspended on a suspension mechanism configured such that the second feeding device is movable back and forth between a first position for receiving the cable exiting the cable bending guide in the second direction and a second position transversal to the first position with respect to the second direction.

2. The drill rig system according to claim 1, wherein the cable bending guide includes an arcuate tube arranged for guiding the cable through the arcuate tube from the first feeding device along said arcuate path.

3. The drill rig system according to claim 1, wherein the first feeding device is configured to receive the cable horizontally or in a direction within ±30 degrees to a horizontal plane or within ±45 degrees to a horizontal plane.

4. The drill rig system according to claim 1, wherein the suspension mechanism includes a plurality of arms hingedly connected to each other such that the second feeding device is movable in a first plane, wherein each hinged connection is provided with a respective drive means for rotating the arms relative to each other thereby controlling the position of the second feeding device in the first plane.

5. The drill rig system according to claim 4, wherein the suspension mechanism is configured such that the first plane is normal to the second direction.

6. The drill rig system according to claim 1, wherein the second feeding assembly includes a gripping claw configured to be movable back and forth between a closed position for gripping the cable and an open position in which the cable is laterally movable out of the gripping claw, wherein the gripping claw is provided with motorized feeding wheels for optionally holding or feeding the cable through the gripping claw in the closed position.

7. The drill rig system according to claim 1, wherein the radius of curvature of the cable bending guide is chosen large enough for the cable not to be plastically deformed upon being fed through the arcuate tube.

8. The drill rig system according to claim 1, wherein the cable handling device is configured such that the second direction differs from the drilling direction of the drill rig by no more than ±10 degrees.

9. The drill rig system according to claim 1, wherein the cable handling device is configured such that the second direction is parallel to the drilling direction of the drill rig.

10. The drill rig system according to claim 1, wherein the suspension mechanism is configured such that the second feeding device in the second position is aligned with the drilling axis of the drill rig.

11. A mining machine comprising a drill rig system according to claim 1, wherein the mining machine is selected from a cutting machine provided with a bolter, a mobile bolter, a bolter car, a bolter miner or a roadheader.

12. The drill rig system of claim 1, further comprising a second feeding assembly which includes a second feeding device movably suspended on a suspension mechanism configured such that the second feeding device is movable back and forth between a first position for receiving the cable exiting the cable bending guide in the second direction and a second position transversal to the first position with respect to the second direction.

13. A method of installing a cable bolt using a drill rig system according to claim 12, said method comprising the steps of:

moving a free end of a cable into the first cable feeding device;

operating the first feeding device to feed the cable through the cable bending guide and into the second feeding device;

operating the suspension mechanism to move the second feeding device to its second position;

operating the second feeding device to feed the cable into a bore hole until the trailing portion of the cable is attachable to the drill head of the drill rig;

disengaging the second feeding device from the cable;

operating the suspension mechanism to move the second feeding device out of the way of the drill head;

attaching the trailing portion of the cable to the drill head; and operating the drill head of the drill rig to work the cable further into the bore and to rotate the cable.

* * * * *